United States Patent [19]

Goerens

[11] 3,961,470

[45] June 8, 1976

[54] C-SHAPED RING TRAVELERS FOR YARN TWISTERS

[75] Inventor: Robert L. Goerens, Esch sur Alzette, Luxemburg

[73] Assignee: Uniroyal Inc., New York, N.Y.

[22] Filed: Dec. 3, 1974

[21] Appl. No.: 529,184

[30] Foreign Application Priority Data

Dec. 5, 1973 Germany ..... 2360615

[52] U.S. Cl. ..... 57/125; 57/119

[51] Int. Cl.[2] ..... D01H 7/60

[58] Field of Search ..... 57/119, 120, 125, 126

[56] References Cited

UNITED STATES PATENTS

| | | | |
|---|---|---|---|
| 3,411,286 | 11/1968 | Wayson | 57/120 |
| 3,621,645 | 11/1971 | Furst | 57/119 |
| 3,664,113 | 5/1972 | Wayson | 57/125 |

FOREIGN PATENTS OR APPLICATIONS

| | | | |
|---|---|---|---|
| 13,972 | 8/1956 | Germany | |
| 722,807 | 2/1955 | United Kingdom | 57/125 |
| 766,697 | 1/1957 | United Kingdom | 57/125 |
| 820,723 | 9/1959 | United Kingdom | 57/125 |
| 964,966 | 7/1964 | United Kingdom | 57/125 |
| 1,199,792 | 7/1970 | United Kingdom | 57/125 |

*Primary Examiner*—John Petrakes
*Attorney, Agent, or Firm*—Norbert P. Holler

[57] ABSTRACT

Generally C-shaped ring travelers, designed for movement along the inside of a ring of a yarn twister or like machine and having, for the purpose of minimizing aerodynamic resistance, overall drop-shaped or streamlined cross-sectional contours at all essential transverse planes, are disclosed. The cross-sectional configuration is characterized by an oblong shape having a relatively wider or blunt leading edge and a relatively narrower or less blunt trailing edge. The foot of the traveler has a pair of laterally offset, generally vertical guide surfaces, which face outwardly of the ring and are somewhat convexly shaped to a degree approximating the ring curvature, for engaging the inside edge of the ring flange and the inside face of the web of the ring, and bridging the space between those surfaces a generally horizontal guide surface for engaging the underside of the inner ring flange. The latter guide surface is somewhat gabled to enhance the stability of the traveler when in motion by providing for a planar rather than a line contact between the traveler and the underside of the ring flange.

18 Claims, 5 Drawing Figures

C-SHAPED RING TRAVELERS FOR YARN TWISTERS

This invention relates to ring travelers for yarn spinning or twisting machines, and in particular to C-shaped travelers.

Travelers for ring twisters and like machines are conventionally designated as either ear-shaped or C-shaped. By way of definition, an ear-shaped traveler is one which is normally used with a ring of generally vertical bar-shaped cross-section and which in use has a primarily straight mid-section of the body thereof extending generally vertically across and traveling along the inside face of the circular ring, and two end sections of the body extending codirectionally generally transversely to the mid-section and outwardly therefrom over the top and bottom edges of the ring, respectively, and terminating in a pair of inwardly directed hook-like ends engaging the outside face of the ring to retain the traveler thereon. A C-shaped traveler, on the other hand, is one which is normally used with a ring of generally T-shaped cross-section and which in use has a primarily arcuate mid-section of the body thereof extending generally horizontally across and traveling along the top face of the ring, and two hook-like end sections (frequently having the form of a relatively thick foot and a relatively thin tip) engaging, respectively, under the inner and outer peripheral top edge flanges of the ring to retain the traveler on the ring.

As is well known, a C-shaped traveler of a ring spinning or twisting machine provides, in the said mid-section of the body thereof, a guide eyelet which travels freely along the ring coaxially with the rotating yarn-receiving bobbin at substantially the rotational speed of the bobbin. The yarn passes through this eyelet and by virtue of the concurrent uniform up and down motion of the ring relative to the bobbin, is helically wound on the bobbin while being at the same time subjected to the desired torsion or twist. The final tension on the yarn while being wound on the bobbin is, in this process, affected by a number of factors. These include, among others, the friction between the traveler and the ring, as well as between the yarn and the traveler. This friction also leads to a substantial wear and tear of both the ring and the traveler.

It is furthermore known to manufacture such travelers either in the form of one-piece structures of metal or of a synthetic plastic material having satisfactory anti-friction properties, or in the form of two-piece structures having an arcuate, slender, yarn-guiding body section formed, for example, of a metal wire, and a broader foot or base section of a synthetic plastic material, the foot section defining the bearing or contact element for the inner ring flange and the guide surfaces engageable with the latter (cf. German Pat. No. 1,004,978 dated Aug. 29, 1957, German Pat. No. 1,289,471 dated Oct. 2, 1969, and German OLS No. 1,685,963 dated Sept. 16, 1971).

These known travelers are suitable for operation at limited rotational speeds only. Provided they are appropriately lubricated, the maximum rotational speed attainable by such a traveler is approximately 50 m/sec, corresponding to about 6,500 rpm at a ring diameter of 150 mm.

In an attempt to minimize problems arising due to the relative speed between a traveler and its associated ring, it has been customary in the industry for the ring to be rotated in the direction of movement of the traveler so as to make the speed differential between the traveler and the ring as low as possible. In German Pat. No. 938,652 dated Feb. 2, 1956, however, it was proposed to rotate the traveler and the ring in opposite directions, so that the speed differential between these two parts becomes the sum of the two speeds (almost approximating double the traveler speed), for the purpose of achieving a reduction of the tensile stresses in the yarn at the traveler. This result has also been enhanced by the fact that at the high speeds attained by the traveler, the latter practically floats on the ring by virtue of the resultant air currents with the contact between the traveler and the ring correspondingly reduced. To this end, the traveler disclosed in the German patent is designed to have an aerodynamic cross-sectional shape and arranged with the narrowest part or tip of the section pointing in the direction of movement of the traveler, so that the latter penetrates into the air like an arrow. In addition, the patent also suggests utilizing the rotating ring to generate air currents by equipping it with appropriate vanes oriented from the bottom toward the traveler, for the purpose of improving its state of suspension.

It is now the object of the present invention to provide an improved C-shaped traveler of the general type described above and in particular to provide such a construction for the traveler that the same can be caused to rotate with less friction and at higher speeds, even without actuation of the ring, than has heretofore been possible, to the end of substantially increasing the productivity of ring spinning or twisting machines utilizing such travelers.

Generally speaking, the objectives of the present invention are attained through the provision of a C-shaped traveler having a relatively heavy or thick foot or base section to which a laterally extending bowed or arched section is secured, with such foot or base section having, when viewed in the normal direction of movement of the traveler, a cross-sectional configuration that, at all points except in the region of certain still to be described guide surfaces, is substantially drop-shaped or airfoil-like in each of at least two mutually perpendicular planes both including the longitudinal axis of the traveler, and with the blunt or wider end of the cross-sectional shape facing in the direction of movement of the traveler and the less blunt or narrower end of the section facing away from the direction of movement of the traveler. On its side which in use will face the ring, the traveler is provided with two longitudinally extending, laterally and vertically offset, generally vertical guide surfaces, one for engagement with the inwardly directed edge of the ring flange and the other for engagement with the inwardly directed face of the web of the ring, and a longitudinally extending, generally horizontal, upwardly facing guide surface intermediate and bridging the gap between the vertical guide surfaces, for engagement with the underside of the inner ring flange. The vertical guide surfaces are somewhat convexly contoured toward the ring with respective curvatures approximating those of the ring surfaces to be engaged thereby, while the horizontal guide surface is somewhat gabled.

By means of this design of the foot or base section of the C-shaped traveler, there results, surprisingly, an extraordinarily secure guidance and stable motion of the traveler along the ring accompanied by a reduction in wear and a substantial increase in the maximum permissible speeds of rotation of the traveler. The increase in the maximum speed of rotation is actually found to amount to 10 percent and more.

The new design of C-shaped travelers according to the present invention can be implemented irrespective of whether they are one-piece constructions or two-piece constructions. In either case, the traveler can be made of either metal or a synthetic plastic material. An arrangement which is particularly suited for a two-piece construction is one in which the foot or base section is made of synthetic plastic material such as nylon and the bowed or arched section is made of a tempered steel wire firmly anchored at one end in the foot or base section. Due to its relative thinness, the narrow bowed or arched section of the body of the traveler does not offer any appreciable air resistance. The provision of the substantially thicker foot or base sections thus makes it possible, by following the teachings of the present invention, to attain a substantial increase in the productivity of a machine with which the traveler is used.

Advantageously, the transverse cross-section of the foot or base section is asymmetrical in shape with reference to a plane substantially parallel to the ring circumference and including the line of greatest length of the base section as measured from the leading to the trailing end thereof, with the major part of the cross-sectional shape being situated on the side of this line closer to the center of the ring. The design may suitably be such that the said line of greatest length, i.e., the longitudinal axis, of the base section diverges or is inclined toward the center of the ring with respect to the direction of movement of the traveler. The friction is particularly low if the cross-sectional shape of the foot or base of the traveler has an airfoil-like profile or configuration in a plane parallel to the ring circumference. The ring-engaging guide surfaces will, of course, be designed with not only the reduction of friction but also the need for guidance and stability of the traveler in motion being taken into consideration.

The narrower or thinner bowed or arched section of the C-shaped traveler can also, if desired, have a corresponding airfoil-like cross-sectional profile. It has been found, however, that, as a rule, the design of the foot or base section of the traveler in accordance with the principles of the present invention is adequate to enable the desired productivity increase to be achieved.

For any traveler according to the present invention, the selection of the plastic material for the base section as well as the formation of the traveler as either a one-piece or a two-piece unit will depend on the particular circumstances and on the type of textile material to be processed.

The foregoing and other objects, characteristics and advantages of the present invention will be more clearly understood from the following detailed description thereof when read in conjunction with the accompanying drawings, in which.

Figure 1:
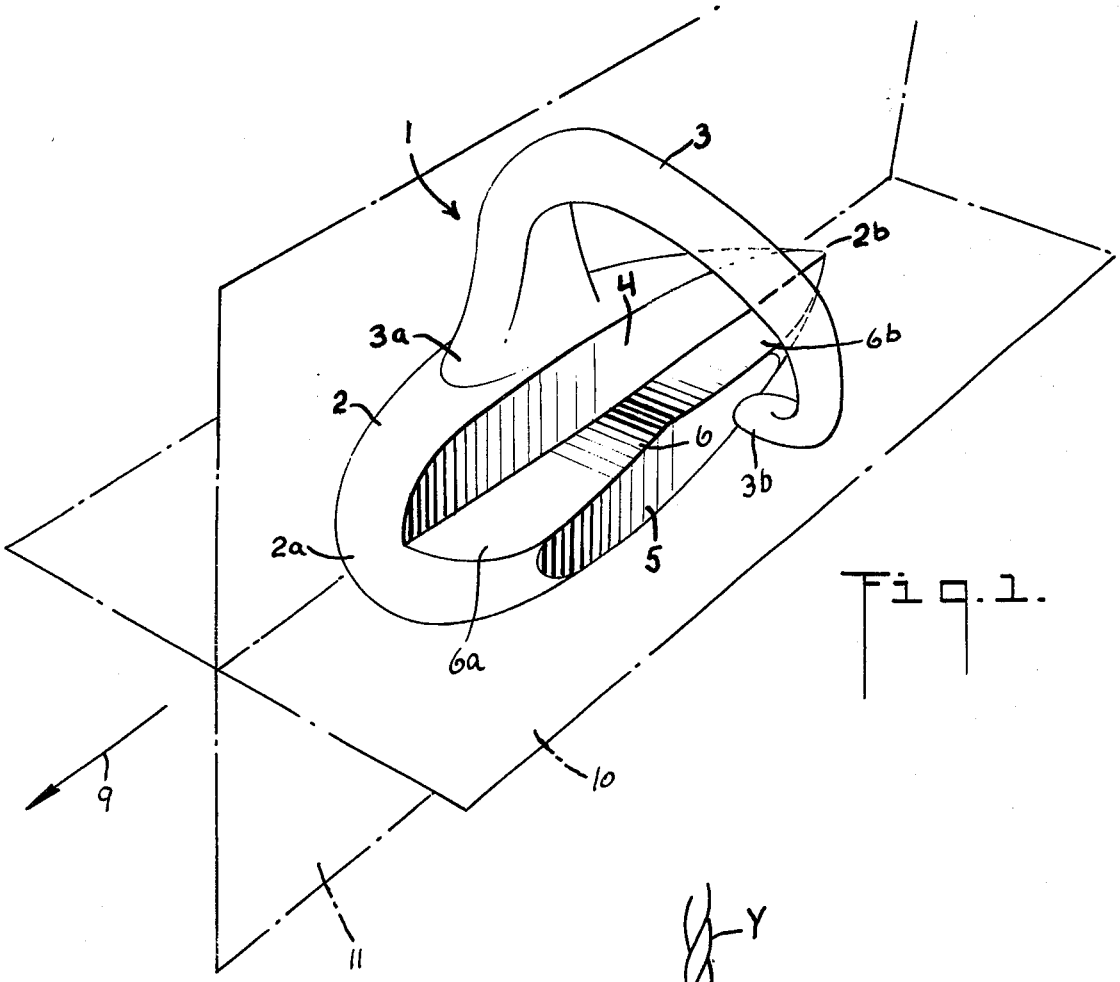
FIG. 1 is a perspective view of a one-piece C-shaped traveler constructed in accordance with the present invention, the foot or base of the traveler being illustrated against the background of two mutually perpendicular planes with respect to which its airfoil-like shape is defined.

Referring now to the drawings in greater detail, there is shown in FIG. 1 a one-piece C-shaped traveler 1 according to the present invention. The traveler has a body which consists of a relatively thick, elongated foot or base section 2, the cross-sectional configuration of which, to be more fully described presently, is one of the features of the present invention, and a relatively thinner, laterally extending, bowed or arched section 3 which merges at one end into the foot or base section 2 medially of the latter along a region **3*a* of gradually increasing thickness and at its other, free end 3*b* bent back toward the foot or base section, i.e., it is generally hook-like in appearance. On the same side as the one to which the bowed or arched section 3 extends, the foot or base section 2 has two laterally and vertically offset, generally vertical guide surfaces 4 and 5 and a generally horizontal guide surface 6 intermediate and bridging the gap between the vertical guide surfaces. The guide surfaces 4, 5 and 6** have certain special characteristics which are additional features of the present invention and will also be more fully described presently.

Figure 2:
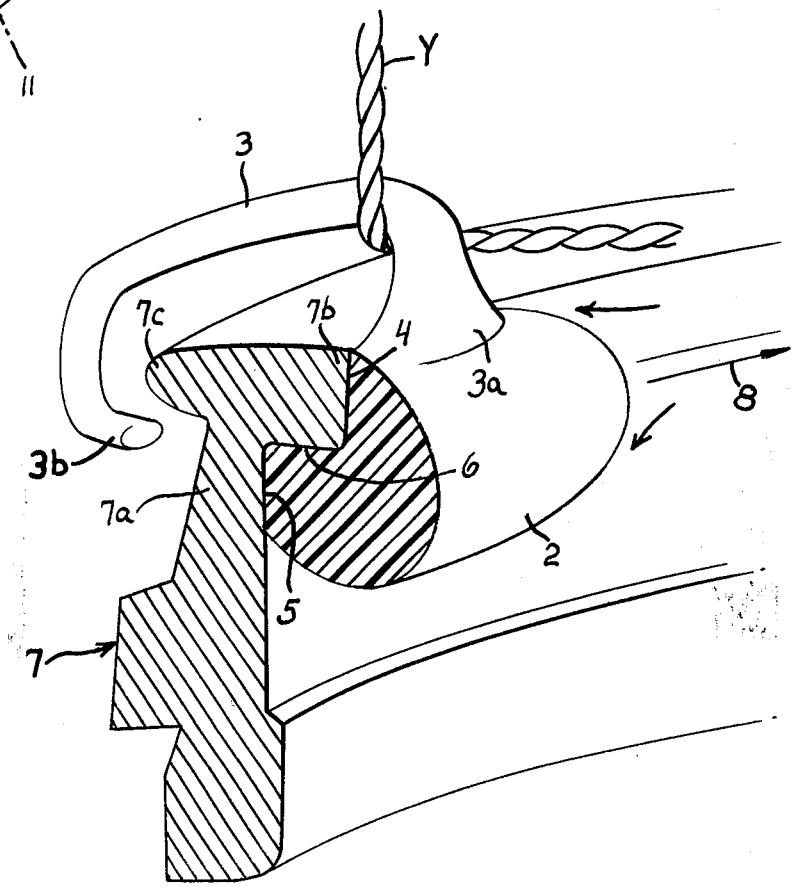
FIG. 2 is a partly sectional, perspective view of the traveler of FIG. 1 on a ring of a twisting or spinning machine.
Figure 3:
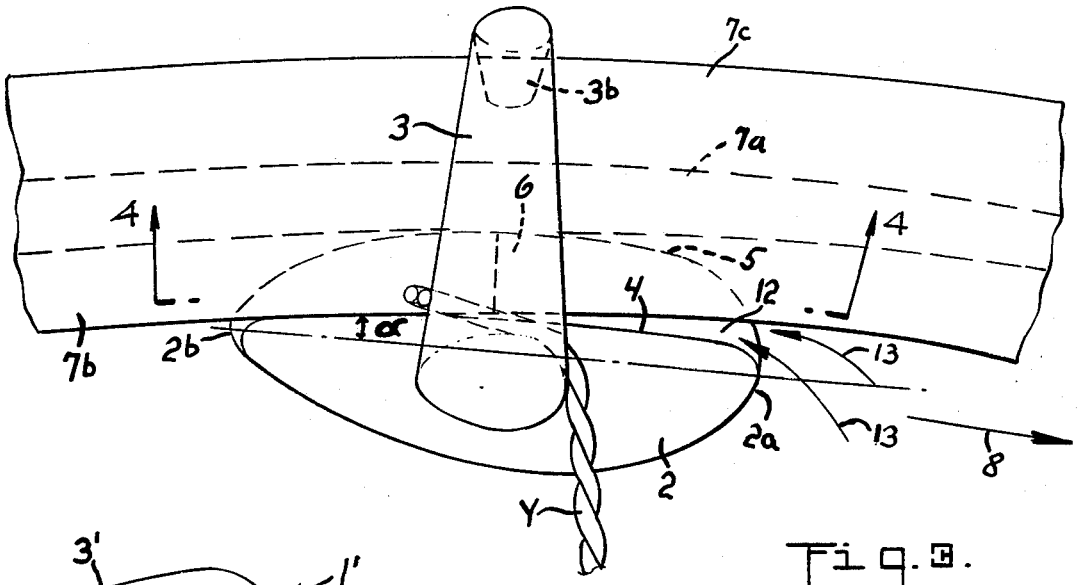
FIG. 3 is a fragmentary top plan view of the traveler and ring shown in FIG. 2.
Figure 4:
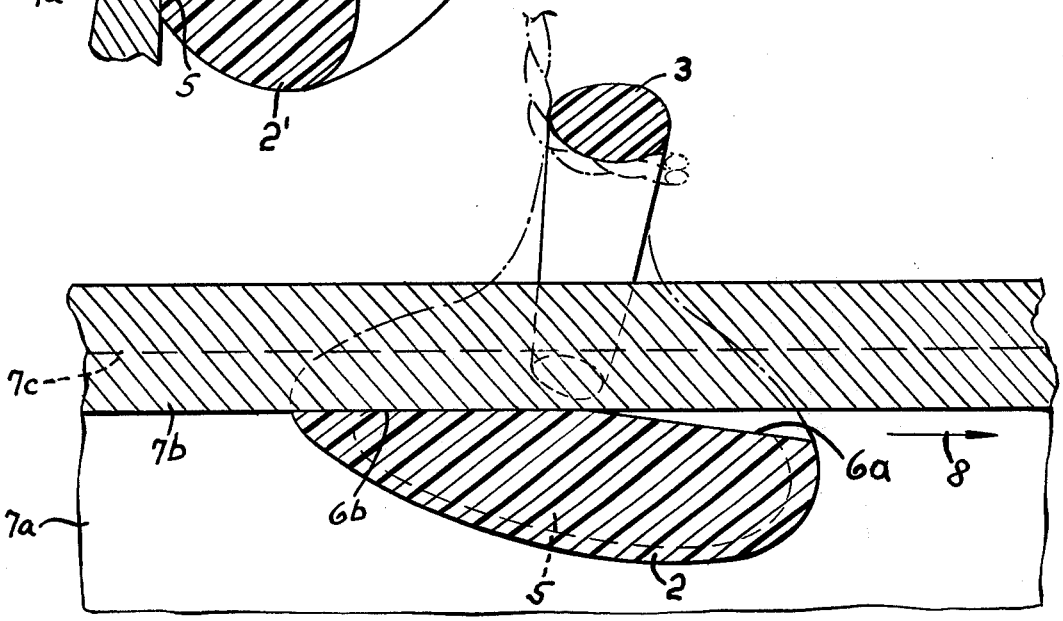
FIG. 4 is a fragmentary sectional view taken along the line 4—4 in FIG. 3.

The C-shaped traveler 1 is intended for use with, and is shown in FIGS. 2 to 4 in operative juxtaposition to, a ring 7 of a spinning or twisting machine (not shown). Such a ring, although design details thereof may vary, in its basic form has a generally upright web **7*a* and a pair of transverse circumferential flanges 7*b* and 7*C* extending, respectively, inwardly and outwardly of the ring, and it may thus be described as being of generally T-shaped cross-section. When the traveler is in use, therefore, moving longitudinally in the direction indicated by the arrow 8, the foot or base section 2 rides longitudinally along the inside of the ring 7, with the vertical guide surfaces 4 and 5 in sliding engagement, respectively, with the free edge of the inwardly facing flange 7*b* and with the inside face of the web 7*a*, while the horizontal guide surface 6 is in sliding engagement with the underside of the flange 7*b*. At the same time, the bowed or arched section 3, which is directed away from the center of the ring, extends across and moves translationally along the top of the ring, with the hook end 3*b* extending in under the free lateral edge of the outwardly facing flange 7*c*. The bowed or arched section 2**, of course, serves in well-known fashion as the means for guiding the yarn Y toward the take-up spindle (not shown) during the twisting operation.

Referring now again to FIG. 1, in accordance with the basic principles of the present invention the foot or base section 2 of the traveler is generally dropshaped and, with reference to its intended normal direction of movement indicated by the arrow 9, has a relatively blunt leading edge **2*a* and a relatively less blunt trailing edge 2*b*. The construction of the foot or base section 2 preferably is such that except for the regions of deviation constituted by the guide surfaces 4, 5 and 6 and the juncture region 3*a*, it has the drop-shaped or airfoil-like cross-section in each of at least two mutually perpendicular planes, shown in dot-dash lines in FIG. 1 and designated 10 and 11, which include the longitudinal axis of the foot or base section 2. In the construction illustrated in FIG. 1, this drop-shaped or airfoil-like cross-sectional configuration is actually provided in all planes which include the longitudinal axis, being absent as previously indicated, only in the region of the guide surfaces 4, 5 and 6 and in the region of the junction 3***a* between the foot or base section 2 of the traveler and the bowed or arched section 3. It should be noted that in making the traveler 1, the formation of sharp edges especially at the said juncture region between the two sections should be avoided.

Preferably, albeit not necessarily, the bowed or arched section 3 of the traveler will also have a drop-shaped or airfoil-like cross-sectional configuration at all essential transverse planes between the ends 3*a* and 3*b* thereof.

It will be understood, of course, that with the foot or base section of the traveler constructed so as to have a drop-shaped or airfoil-like cross-section as hereinabove described, the traveler will be characterized by a minimized aerodynamic resistance even if the cross-sectional configuration of the foot or base section is symmetric with respect to the longitudinal axis of the latter. It has been found, however, that an additional counteracting influence on the centrifugal forces and on the normally high frictional forces which tend to be generated between the foot or base section of the traveler and the ring when the former is in motion, can be effected through the use of a C-shaped traveler in which the cross-sectional shape of the foot or base section is asymmetrical with respect to a given longitudinal dividing line or plane, i.e., the longitudinal axis, of the section, with the larger portion of the section being disposed to the side of the said axis which is closer to the center of the ring, subject only to the section having a wider or more blunt leading edge and a narrower or less blunt trailing edge. As a result, the air flowing past the traveler when the same is in motion will exert a lifting force thereon tending to hold its foot or base section away from the ring in opposition to the centrifugal forces tending to hold the foot or base section in contact with the ring.

Reverting now to the guide surfaces 4, 5 and 6, the special characteristics thereof which are contemplated by the present invention are best shown in FIGS. 1, 3 and 4. In particular, it will be seen that the vertical guide surfaces 4 and 5 are flat but somewhat convexly contoured laterally outwardly of the foot or base section 2 of the traveler, their curvatures being such as to accommodate the curvatures of the ring flange 7*b* and web 7*a*, respectively. Preferably, however, at least the guide surface 4 should be formed so that at its leading end region it will diverge somewhat from the opposed free edge of the inner ring flange 7*b* even when the traveler is at rest. Thus, in that region of the guide surface, the same may be somewhat planar or its curvature made slightly greater. This will provide an access space 12 for the air flowing counter to the direction of movement of the traveler, i.e., in the direction of the arrows 13 in FIG. 3, and thereby will enhance the generation of lift forces on the foot or base section of the traveler by which to minimize the frictional contact between the guide surfaces 4 and 5 and the opposed surfaces of the ring. The horizontal guide surface 6, on the other hand, is somewhat gabled from its medial region both forwardly and aft with respect to the direction of movement of the traveler, to provide a downwardly slanted leading surface portion 6*a* and a downwardly slanted trailing surface portion 6*b*. This ensures that even when the traveler assumes a forwardly tilted position during a twisting operation, as it will under the forces exerted thereon by the yarn Y, the foot or base section of the traveler will remain in areal or surface contact with the underside of the ring flange 7*b* over the entire expanse of the trailing surface portion 6*b*, as shown in FIG. 4, albeit the contact will also be very light because of the aerodynamic lift forces exerted on the foot or base section 2.

The effects of friction can also be advantageously influenced, i.e., minimized, in the case of a C-shaped traveler having a foot or base section with a cross-sectional configuration which is substantially drop-shaped or airfoil-like as herein described and has a relatively wider or more blunt leading edge and a relatively narrower or less blunt trailing edge, by constructing the section so that its longitudinal axis is oriented so as to diverge from the ring 7 (or more accurately from a tangent to the ring at the rearwardmost point of contact) inwardly thereof at an acute angle $\alpha$ not in excess of about 30° but preferably greater than about 5°. The resultant air flow around the foot or base section helps to impart to the same a buoyancy or lift directed toward the center of the ring and counteracting the centrifugal forces acting in the direction away from the center of the ring. By appropriately selecting the cross-sectional configuration and the magnitude of the angle $\alpha$, therefore, the friction between the traveler and the ring can in this manner be reliably and sensitively influenced.

A one-piece C-shaped traveler can be made, for example by injection molding techniques, of either metal or a synthetic plastic material having appropriate anti-friction and wear resistance properties. Representative materials of the two classes are steel and nylon, but others equivalent thereto will readily suggest themselves to those skilled in the art.

Figure 5:
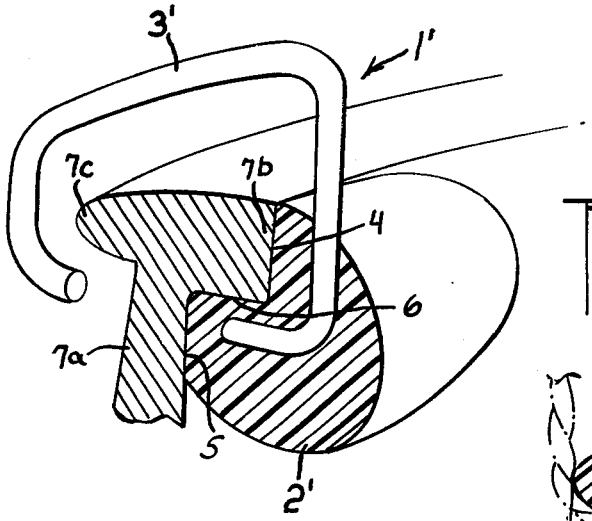
FIG. 5 is a view similar to FIG. 2 and shows a two-piece traveler according to the present invention.

A traveler 1′ according to the present invention but made in the form of a two-piece construction is illustrated in FIG. 5. In this embodiment, the body of the traveler 1′ has a foot or base section 2′ and a separate bowed or arched section 3′ anchored therein. Merely by way of example, the latter may be made of an appropriately stiff steel wire and the former of a synthetic plastic material such as nylon, the two sections being secured together by molding synthetic plastic material for the foot or base section directly onto one end region of the metal wire. Both sections may also be made of the same material. Other than in these respects, the foot or base section 2′ and the bowed or arched section 3′ correspond directly to the sections 2 and 3, respectively, of the body of the one-piece traveler 1. Thus, the foot or base section 2′ has a blunter leading end and a less blunt trailing end (the latter is not shown), it may be either asymmetric with respect to its longitudinal axis, as shown, or symmetrical, its longitudinal axis will preferably diverge from the ring (i.e., a tangent to the ring) inwardly of the ring at an angle of from about 5° to about 30°, and it has convex generally vertical guide surfaces 4 and 5 and an intermediate generally horizontal guide surface 6. The bowed or arched section 3′ may, of course, be constituted by an element having a drop-shaped or airfoil-like cross-section.

It will be understood that the foregoing description of representative embodiments of the present invention is for purposes of illustration only, and that the various structural and operational features herein disclosed are susceptible to a number of modifications and changes none of which entails any departure from the spirit and scope of the present invention as defined in the hereto appended claims.

What is claimed is:

1. A C-shaped ring traveler designed for movement in only one given direction along a ring of a yarn twister or like machine, wherein the ring is of generally T-shaped cross-section and has a generally upright annular web and at the top of the latter a pair of generally transverse circumferential flanges the free lateral edges of which face inwardly and outwardly of the ring, respectively;

a. said traveler having a body including (i) a relatively thicker elongated foot or base section which, when the traveler is in use, is juxtaposed to and moves longitudinally along the inside of the ring, and (ii) a relatively thinner transverse bowed or arched section which, when the traveler is in use, extends generally horizontally across and moves translationally along the top of the ring, said bowed or arched section being secured to and extending laterally from a medial portion of said foot or base section and terminating in a hook-like free end which, when the traveler is in use, extends in under said free lateral edge of and moves translationally along beneath said outwardly facing flange of the ring;

b. said foot or base section of said body on the side thereof which faces toward said hook-like free end of said bowed or arched section having (i) a pair of laterally and vertically offset, generally vertical guide surfaces for sliding engagement, respectively, with said free lateral edge of said inwardly facing flange and with the surface of said web beneath said inwardly facing flange of the ring, and (ii) a generally horizontal guide surface intermediate and bridging the gap between said vertical guide surfaces for sliding engagement with the underside of said inwardly facing flange of the ring; and c. said foot or base section of said body having throughout its expanse, except at the locations of said vertical and horizontal guide surfaces, a cross-sectional configuration (i) which is generally drop-shaped or airfoil-like with reference to each of two mutually perpendicular planes including the longitudinal axis of said foot or base section, (ii) which has, as viewed with reference to said given direction of movement of the traveler, a relatively blunt leading edge and a relatively less blunt trailing edge, and (iii) which, when the traveler is in use, is effective to generate aerodynamic lift forces directed inwardly of the ring so as to oppose the effects of centrifugal forces on said foot or base section of said body and thereby to minimize rubbing friction between said vertical guide surfaces and, respectively, said free lateral edge of said inwardly facing flange and said surface of said web beneath said inwardly facing flange.

2. A traveler as claimed in claim 1, wherein said cross-sectional configuration of said foot or base section of said body, as viewed in a plane which includes said longitudinal axis and is generally parallel to the plane of the ring when the traveler is mounted thereon, is asymmetrical with respect to said longitudinal axis and has its larger portion located to the side of said longitudinal axis facing away from said hook-like free end of said bowed or arched section and thereby toward the center of the ring when the traveler is mounted thereon.

3. A traveler as claimed in claim 1, wherein each of said vertical guide surfaces is flat but somewhat convexly curved laterally outwardly of said foot or base section of said body sufficiently to accommodate the curvature of the ring, and said horizontal guide surface is flat but somewhat gabled transversely medially thereof to provide leading and trailing flat surface portions so that, even when the traveler tilts forwardly when mounted on the ring and in use, an area or surface contact is maintained between said trailing portion of said horizontal guide surface and said underside of said inwardly facing flange of the ring.

4. A traveler as claimed in claim 3, wherein the convexity of at least that vertical guide surface which is to engage said free lateral edge of said inwardly facing flange of the ring is such that at the leading end region of that vertical guide surface the same diverges somewhat from said free lateral edge when said foot or base section is juxtaposed to the ring, to enhance the aerodynamic lift properties of said foot or base section and thereby further minimize the frictional contact between the same and the ring.

5. A traveler as claimed in claim 3, wherein said cross-sectional configuration of said foot or base section of said body, as viewed in a plane which includes said longitudinal axis and is generally parallel to the plane of the ring when the traveler is mounted thereon, is asymmetrical with respect to said longitudinal axis and has its larger portion located to the side of said longitudinal axis facing away from said hook-like free end of said bowed or arched section and thereby toward the center of the ring when the traveler is mounted thereon.

6. A traveler as claimed in claim 1, wherein said bowed or arched section of said body at all essential transverse planes has a generally drop-shaped or airfoil-like cross-sectional configuration which is characterized by a relatively blunt leading edge and a relatively less blunt trailing edge and, when the traveler is in use, is aerodynamically neutral while affording minimized air resistance.

7. A traveler as claimed in claim 1, wherein said foot or base section of said body is constructed and arranged to have said longitudinal axis thereof inclined at an acute angle $\alpha$ to the rearwardmost portions of said vertical guide surfaces in a direction away from said hook-like free end of said bowed or arched section.

8. A traveler as claimed in claim 7, wherein the angle $\alpha$ is between about 5° and about 30°.

9. A traveler as claimed in claim 1, wherein said body is a one-piece construction made of a material having suitable wear-resistance and antifriction properties.

10. A traveler as claimed in claim 9, wherein said material is selected from the group consisting of metals and synthetic plastics.

11. A traveler as claimed in claim 10, wherein said material is steel.

12. A traveler as claimed in claim 10, wherein said material is nylon.

13. A traveler as claimed in claim 1, wherein said body is a two-piece construction, with said foot or base section and said bowed or arched section each being made of a material having suitable wear-resistance and antifriction properties.

14. A traveler as claimed in claim 13, wherein said material is selected from the group consisting of metals and synthetic plastics.

15. A traveler as claimed in claim 14, wherein said material is steel.

16. A traveler as claimed in claim 14, wherein said material is nylon.

17. A traveler as claimed in claim 14, wherein said material of which said foot or base section is made is different from said material of which said bowed or arched section is made.

18. A traveler as claimed in claim 17, wherein said material of which said base or foot section is made is nylon, and said material of which said bowed or arched section is made is steel.

* * * * *